US008201629B2

(12) United States Patent
Green

(10) Patent No.: US 8,201,629 B2
(45) Date of Patent: Jun. 19, 2012

(54) STAGING TOOL SEAL ARRANGEMENT FOR GAS WELLS

(75) Inventor: David A. Green, Highlands Ranch, CO (US)

(73) Assignee: Well Master Corp., Golden, CO (US)

( * ) Notice: Subject to any disclaimer, the term of this patent is extended or adjusted under 35 U.S.C. 154(b) by 304 days.

(21) Appl. No.: 12/586,736

(22) Filed: Sep. 25, 2009

(65) Prior Publication Data

US 2010/0089595 A1 Apr. 15, 2010

Related U.S. Application Data

(63) Continuation-in-part of application No. 12/217,756, filed on Jul. 8, 2008, now Pat. No. 7,793,728, and a continuation-in-part of application No. 11/715,216, filed on Mar. 7, 2007, now Pat. No. 7,748,448, which is a continuation of application No. 11/350,367, filed on Feb. 8, 2006, now Pat. No. 7,395,865.

(60) Provisional application No. 61/194,269, filed on Sep. 25, 2008, provisional application No. 60/593,914, filed on Feb. 24, 2005.

(51) Int. Cl.
*E21B 31/18* (2006.01)
*E21B 23/00* (2006.01)
*E21B 43/12* (2006.01)

(52) U.S. Cl. ..... 166/301; 166/68; 166/98; 166/106; 166/178; 166/387

(58) Field of Classification Search ..... None
See application file for complete search history.

(56) References Cited

U.S. PATENT DOCUMENTS 3,856,082 A * 12/1974 Dinning ..... 166/154
4,487,263 A * 12/1984 Jani ..... 166/289
5,518,072 A * 5/1996 McTernaghan ..... 166/115

* cited by examiner

*Primary Examiner* — Zakiya W Bates
(74) *Attorney, Agent, or Firm* — Don Halgren

(57) ABSTRACT

A staging tool arrangement for gas well production assistance, comprising an elongated staging tool having an elongated upper portion and an elongated lower portion. The upper portion has a sliding relationship with the lower portion thereof. A displaceable annular seal is arranged about the lower portion. A displaceable enclosure is arranged on the elongated lower portion so as to slidably expose and to slidably enclose the annular seal.

14 Claims, 8 Drawing Sheets

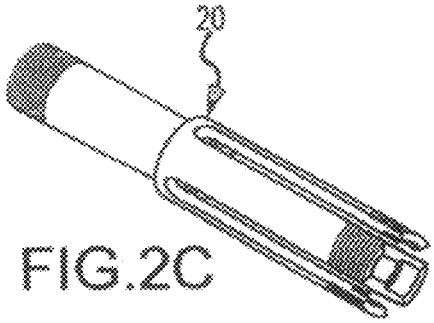
FIG.2C
FIG.2B
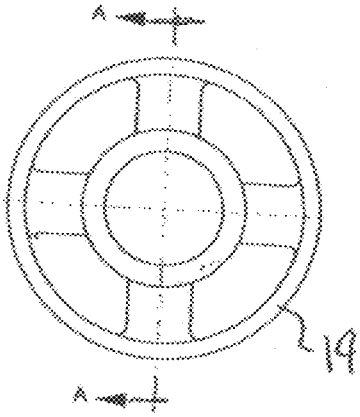
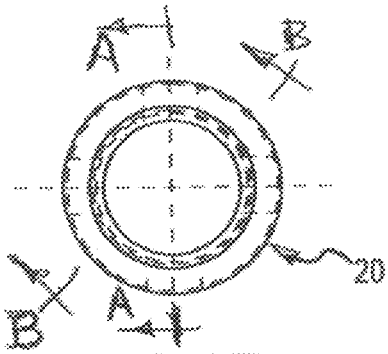
FIG.2D

STAGING TOOL SEAL ARRANGEMENT FOR GAS WELLS

This invention relates to staging tool arrangements for gas well production, and more particularly to adaptable seals for those staging tools to minimize well downtime and tool maintenance, and is based upon Provisional patent application, Ser. No. 61/194,269, filed 25 Sep. 2008, and is a continuation-in-part application of Ser. No. 11/715,216 filed 7 Mar. 2007, now U.S. Pat. No. 7,748,448 and also of Ser. No. 12/217,756 filed 8 Jul. 2008, now U.S. Pat. No. 7,793,728, which is a continuation of Ser. No. 11/350,367 filed 8 Feb. 2006, now U.S. Pat. No. 7,395,865 which was based upon Provisional Patent Application 60/593,914, filed 24 Feb. 2005, and on Ser. No. 12/313,279, filed 18 Nov. 2008, each of which is incorporated herein by reference in its entirety.

FIELD OF THE INVENTION

BACKGROUND OF THE INVENTION

Production of natural gas from drilled wells often has associated liquid production. The liquids may consist of water, oil or hydrocarbon condensates in any combination. A free flowing gas well may, over time, accumulate liquids in the well bore that are not carried to surface due to flow rates that are insufficient to entrain the liquid and keep it moving out of the well. In these cases, the liquids will accumulate to the extent that they build up in the well bore and exert a hydrostatic pressure against the producing part of the underground formation. This build up of liquid will continue until the hydrostatic pressure from the liquid equals or exceeds the natural pressure of the producing formation, and all flow of gas and liquids from that formation are stopped.

Various methods of removing the liquids from the wellbore are well known and in use. One such method is "Plunger Lift", whereby a freely reciprocating piston, or plunger, is operated in an intermittent or continuous fashion, allowing the plunger to fall through the accumulated liquid to the bottom of the wellbore and then return to surface, pushing the liquid ahead of it and clear of the wellbore. This way, the back pressure against the formation is reduced or minimized and the well produces at a rate closer to it's theoretical maximum.

Recent years have seen the development of two-stage or multi-stage plunger lift systems. These systems utilize a two or more plungers in a staged arrangement in a single well. There are one or more staging tools placed at intermediate intervals in the well such that a separate plunger operates in each discrete segment or stage of the well. The staging tools are designed to isolate the well into discrete sections or chambers, usually with a one-way valve arrangement that allows the lowest sections to sequentially move the liquids up the well into the next chamber without permitting fallback of those liquids. This sequential lifting of the liquids allows the well to operate with lower gas volumes than single stage plunger lift, thereby providing a wider range of applications.

Current designs of staging tools incorporate two areas where a seal must be established to prevent the backflow of liquids. One is the use of a one-way valve where the main flow of gas and liquids pass though on their way to the surface. Typically a ball and seat arrangement or similar arrangement is used. The second area that needs to be sealed is the annular area between the tool and the production tubing. This is commonly achieved by the use of an elastomeric seal.

The annular elastomeric seals currently in use may remain exposed to the tubing wall both during the process of setting the tool and on it's extraction. Some tools simply use a seal such as a swab cup fitted over a sleeve. Other known art employs a retractable seal which is essentially an elastomeric bushing which is expanded when the device is set in the well by means of a tapered shaft forcing the bushing against the tubing wall. Upon extraction, the tapered shaft is removed from the elastomeric bushing allowing it to collapse away from the tubing wall. Known problems with this latter art is the nature of elastomers to take a "set" after a period of time, whereby they do not return to their original shape after the force which was holding them in place is removed. In such cases the elastomeric seal remains exposed and potentially in contact with the tubing wall leaving it prone to damage upon extraction.

The object of the proposed invention is to improve upon the known art of staging tool design, specifically by providing a means of protecting an elastomeric seal upon withdrawal of the tool from the well. This invention eliminates the problems associated with seal damage on extraction, thus avoiding problems to associated equipment when damaged seal components fall into the well and reducing the need for costly and time consuming rebuild of the staging tool.

BRIEF DESCRIPTION OF THE DRAWINGS

FIG. 2BB is a view taken along the lines A-A in FIG. 2B;

FIG. 2C is a perspective view of the retaining sleeve;

FIG. 2D is an end view of the retaining sleeve shown in FIG. 2C;

BRIEF SUMMARY OF THE INVENTION

Figure 1A:
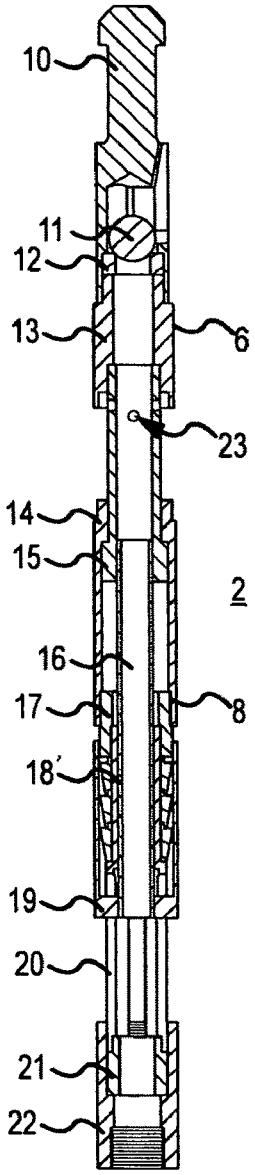
FIG. 1A is a longitudinal sectional view of the staging tool configured for placement or extraction from a well.
Figure 4:
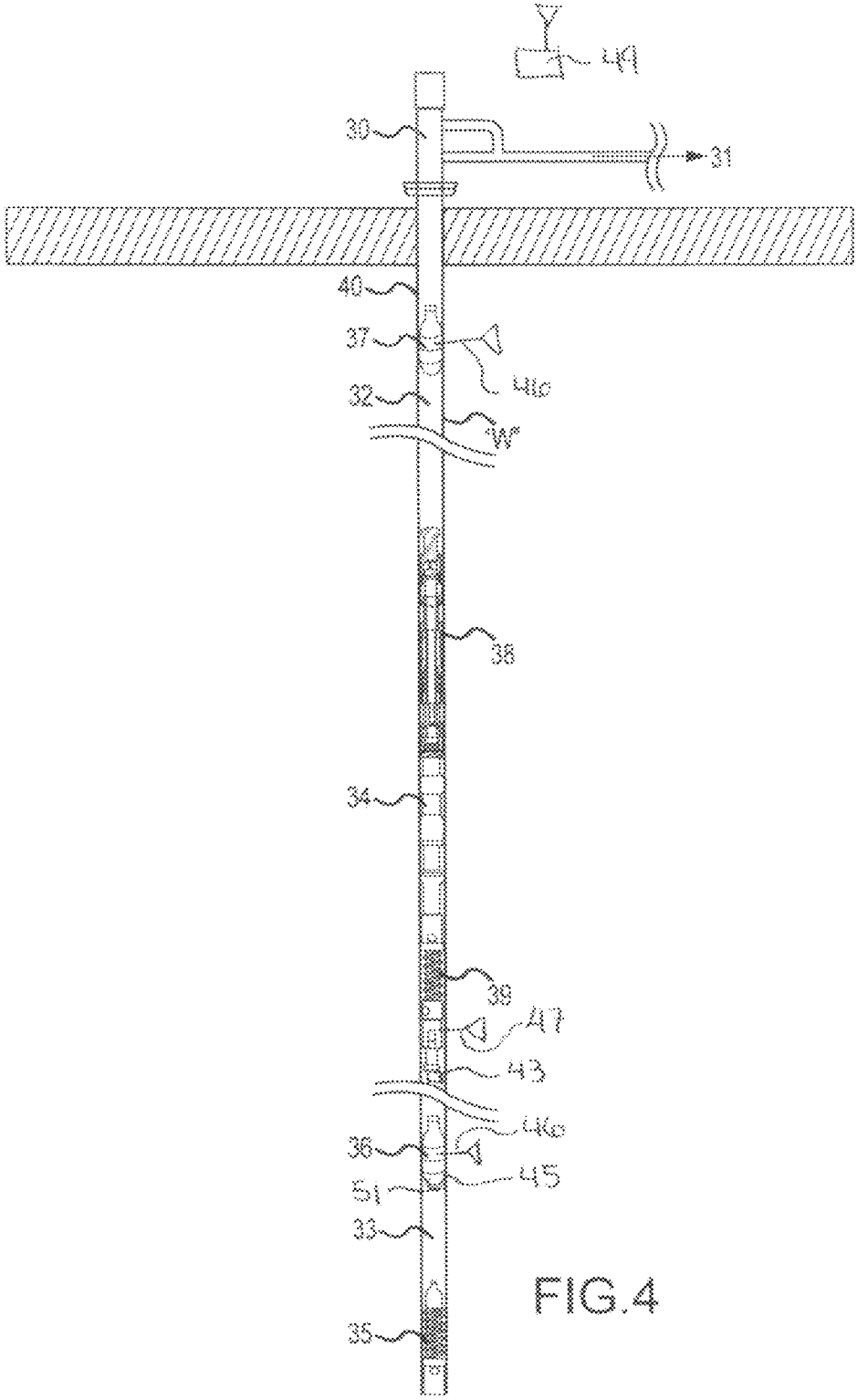
FIG. 4 is a side elevational view of a well arrangement with production tubing and a staging tool arranged therewithin.
Figure 5:
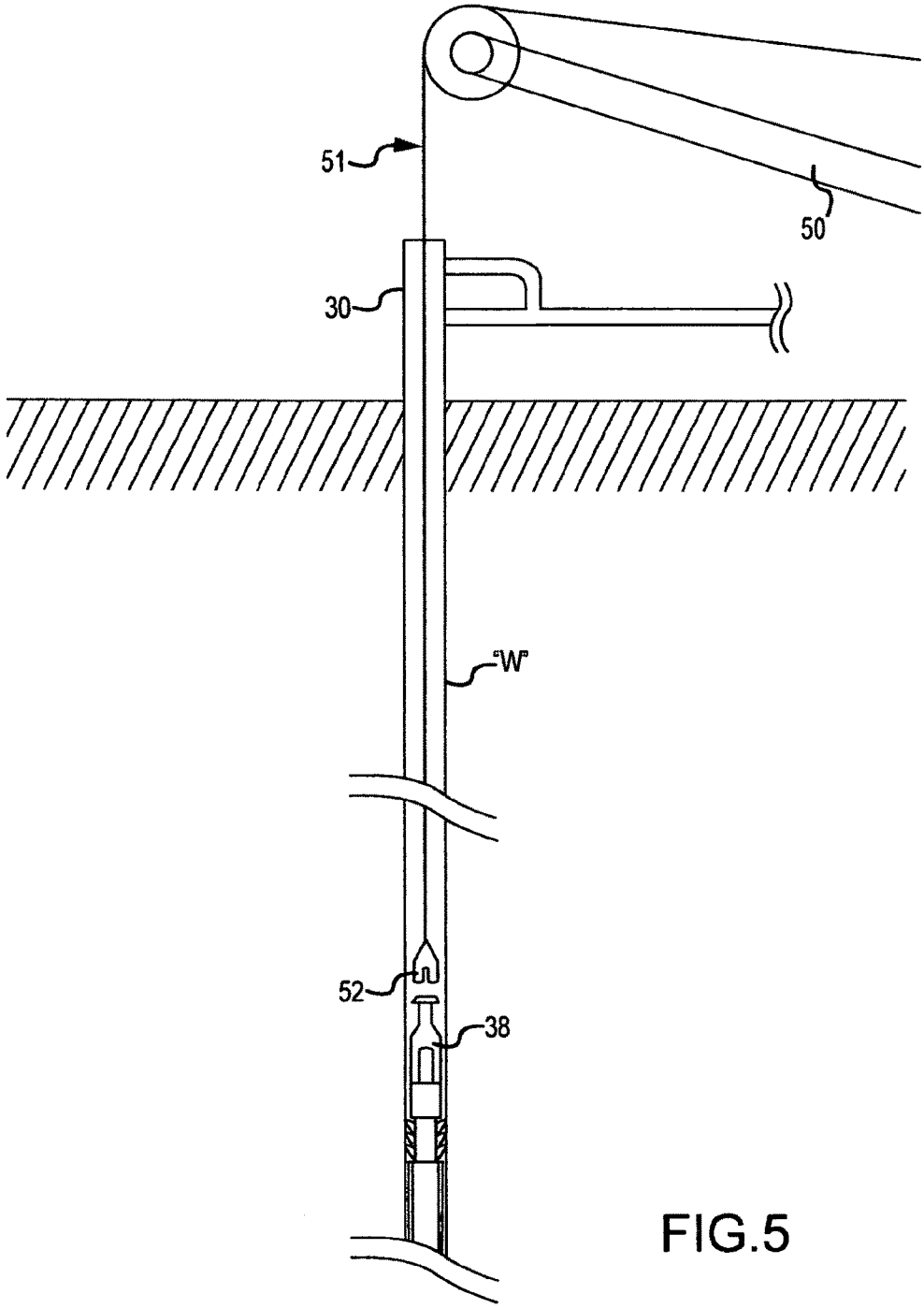
FIG. 5 is a side elevational view of a wireline rig setting up a staging tool operation.

The present invention provides for a means of protecting the elastomeric seal from damage as the tool 2 is moved through the well 40 as represented in FIG. 4, to or from the desired location in the production tubing, as represented in FIG. 5. The means of protection comprises a cylindrical sleeve 19, represented in FIGS. 1A and 1B, that has an inner diameter which can be slidably moved over the elastomeric seal 18, as best represented in FIGS. 2H and 2I. The cylindrical sleeve 19 can be set in place at surface in preparation to set the tool, protecting the elastomeric seal by preventing contact with the wall of the production tubing. The normal means of setting the locating device (common locating devices are commercially available and known as a collar stop or tubing stop) requires a strong downward jarring action which is provided by the wireline rig. This action pushes the cylindrical sleeve 19 in a downward direction relative to the elastomeric seal 18, allowing it to expand, as represented between FIGS. 2I and 2H, to contact the tubing wall "W" represented in FIG. 1B, and thereby providing the desired annular seal.

The extraction of the tool from the well is also done using a wireline service rig, as represented in FIG. 5. A normal extraction device would be deployed from surface and connect to the fishing neck 10. Upward jarring force exerted by the wireline first exposes the pressure relief holes which allow fluid retained above the tool 2 to bypass and fall through the inner passage to the next lower chamber in the tubing. Further upward force pulls the cylindrical sleeve 19 upwards where it contacts and radially inwardly compresses the elastomeric seal 18 until the seal 18 is fully enclosed and thus protected. Retracting the seal 18 releases any remaining pressure from the liquid above the staging tool and frees the tool from direct sealing or holding contact with tubing wall "W" that would have existing by virtue of the contact of the seal to the tubing wall. Once the seal 18 is fully enclosed, as represented in FIG. 1A and FIG. 2I, the upward force is transferred to the upper element of the locating device as all of the sliding components inside the tool will be in direct contact with one another. This now permits the wireline to disengage the locating device (collar stop or tubing stop) in the manner which is normal for such tools, and to then retrieve the entire tool from the well.

Once extracted from the well "W", the tool 2 can be inspected and serviced as needed. The elastomeric seal 18, if in good and reusable condition can simply be covered by ensuring the tool is in the extended and protective position prior to replacement in the well. If need be, the tool can be disassembled and a replacement elastomeric seal can be installed and the process as described above can be carried out to place the tool in the well.

Figure 1B:
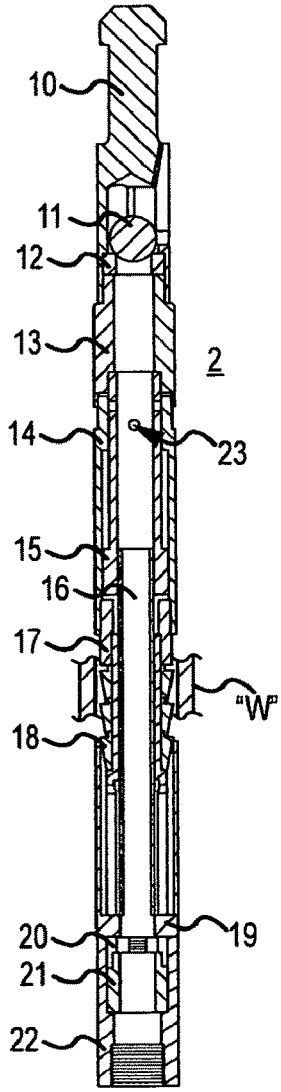
FIG. 1B is a longitudinal sectional view of the staging tool set in an operational configuration.
Figure 2A:
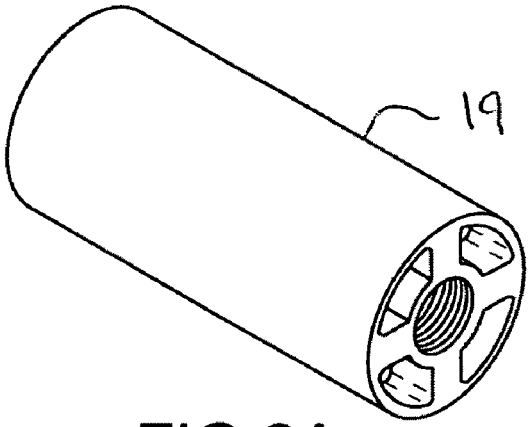
FIG. 2A is a perspective view of the seal retractor cup.
Figure 2B:
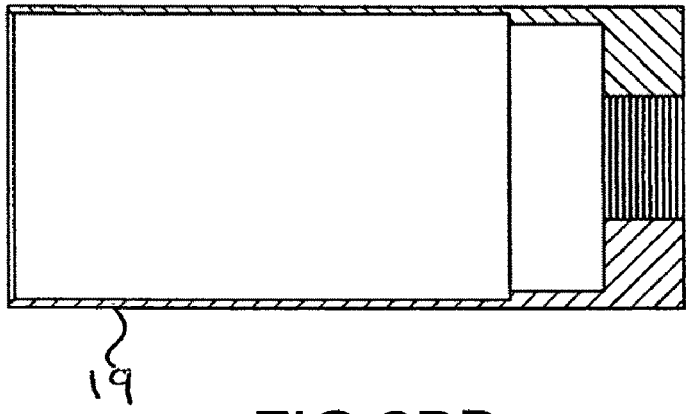
FIG. 2B is an end view of the seal retractor cup shown in FIG. 2A.
Figure 2E:
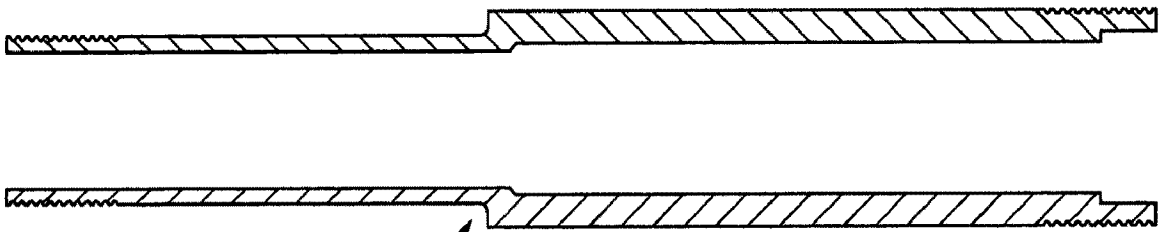
FIG. 2E is a view taken along the lines B-B in FIG. 2D.
Figure 2F:
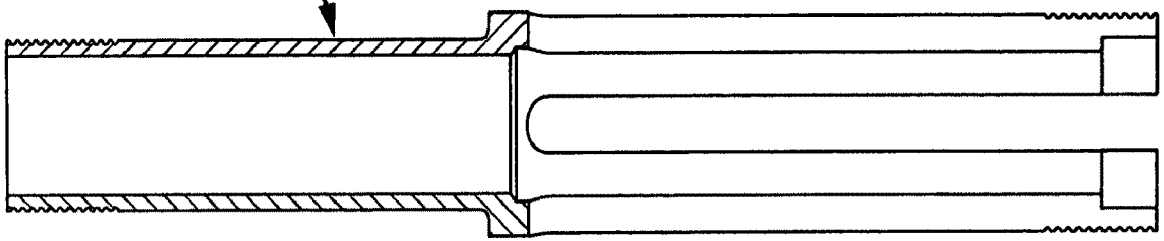
FIG. 2F is a view taken along the lines A-a in FIG. 2D.
Figure 2I:
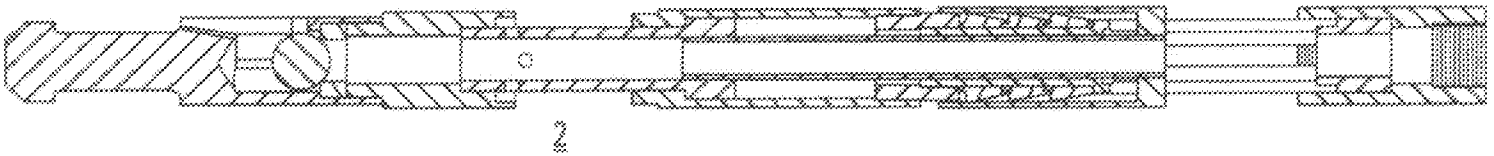
FIG. 2I is a further longitudinal sectional view of the staging tool in its placement configuration.
Figure 2H:
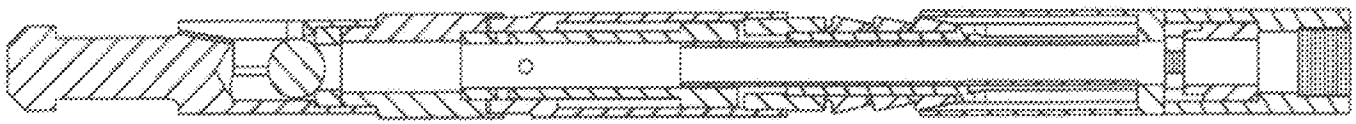
FIG. 2H is a further longitudinal sectional view of the staging tool in its operational configuration.
Figure 2G:
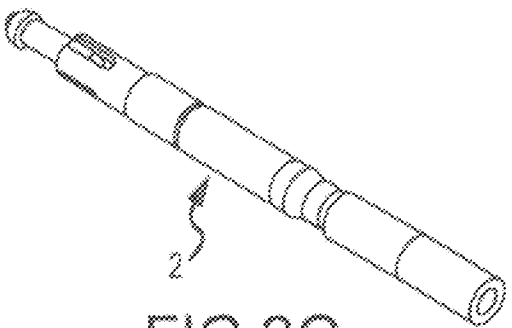
FIG. 2G is a perspective view of the staging tool.

The central part of the tool as represented in FIGS. 1A and 1B comprises an upper continuous assembly 6 which is slidably connected to a lower continuous assembly 8. The upper assembly 6 is moved in the well by means of the wireline relative, as represented in FIG. 5, to the lower assembly 8, which is fixed in location with the locating device (tubing stop or collar stop).

The upper assembly 6 is determined as follows. A fishing neck and cage assembly (10) is threadedly attached to the upper coupling (13) in such a way that it retains the one-way valve consisting of the ball (11) and its corresponding seat (12). The upper coupling (13) is threadedly attached to the sliding connector (15) and there through to the seal retractor cup (19) by means of the tubular connecting rod (16) thereby making one complete rigid structure from the fishing neck and cage (10) through to the seal retractor cup (19).

The lower assembly 8 is determined as follows. The lowermost part of the tool, the locating tool coupling (22) is threadedly attached at it's lower end to the locating tool (collar stop or tubing stop). The upper part of the locating tool coupling (22) is threadedly attached to the seal cup retainer sleeve (20), holding in place support ring (21). The lowermost part of the seal cup retainer sleeve (20) consists of a cylindrical hollow section segmented longitudinally to provide a guided means of travel for seal retractor cup (19) in the upper assembly. The lower segments of the seal cup retainer sleeve (20) are supported and prevented from collapsing inwardly in the radial direction by the support ring (21). The seal cup retainer sleeve is threadedly attached to the seal retainer (17) which in turn is threadedly attached to the sliding sleeve (14). The elastomeric seal (18) is a multi-lip style seal molded onto a metallic hollow core and assembled over the elongated portion of the seal cup retainer sleeve (20) and held in position by the seal retainer (17).

Movement in the longitudinal direction between the upper assembly and lower assembly effectively allow the seal retractor cup (19) to move in relation to the elastomeric seal (18). This movement is facilitated by design of the seal retractor cup (19) which has a lower portion with slots which allow passage for the lower segments of the seal cup retainer sleeve (20). The sliding connector (15) is able to move longitudinally through the sliding sleeve (14) when force is applied in either direction.

When setting the tool in the well, as represented in FIG. 5, the force is directed downwards into the fishing neck and cage assembly (10) to the upper coupling (13) and into the sliding connector (15), driving the sliding connector (15) down to a point where it contacts the seal retainer (17). The force is then transferred further downwards from the seal retainer (17) through the seal cup retainer (20) to the support ring (21) and the locating tool coupling (22) and thereby into the locating tool. This permits the locating tool to be set and locked in place by the sharp application of force imparted by the wireline rig at surface. The internal elements of the upper assembly also move downwards with the force traveling from the fishing neck and cage assembly (10) to the upper coupling (13) and into the sliding connector (15), then to the tubular connecting rod (16) and to the seal retractor cup (19). This moves the seal retractor cup (19) downwards and clear of the elastomeric seal (18). The longitudinal shuttling motion permitted in the tubular connecting rod (16) within the elastomeric seal (18) may have portions radially adjacent the seal (18) of tapering configuration to facilitate radial movement (inwardly and outwardly) of the seal (18), depending upon the location of the tapered portion during the shuttling procedure.

Extracting the tool from the well involves an upward pulling force exerted by the wireline rig to the fishing neck and cage assembly (10). This action first causes the vertical movement of the fishing neck and cage assembly (10), the upper coupling (13), the sliding connector (15), the tubular connecting rod (16) and the seal retractor cup (19). The entire lower assembly remains fixed and rigidly held in place by virtue of the connection to the locating tool which remains locked in position during the initial travel of the upper assembly. The initial upward movement of the upper assembly exposes the pressure relief holes (23) allowing liquid retained above the tool to pass through the hollow center to the next lower chamber. The seal retractor cup (19) moves vertically upwards and in this movement compresses and covers the elastomeric seal (18), further releasing the liquid from the next upper chamber into the next lower chamber, retracting the elastomeric seal (18) and preventing contact with the production tubing wall. The upward movement continues until the full travel of the sliding connector (15) is completed by contact at the upper internal end of the sliding sleeve (14). At this point the upward forces are carried from the fishing neck and cage assembly (10) to the upper coupling (13), to the sliding connector (15), to the sliding sleeve (14), to the seal retainer (17), to the seal cup retainer (20) and to the locating tool coupling (22). The locating tool coupling (22) transfers the upward force imparted by the wireline service rig to the locating tool, allowing it to release from the production tubing wall and to permit extraction of the entire assembly from the well.

Figure 3:
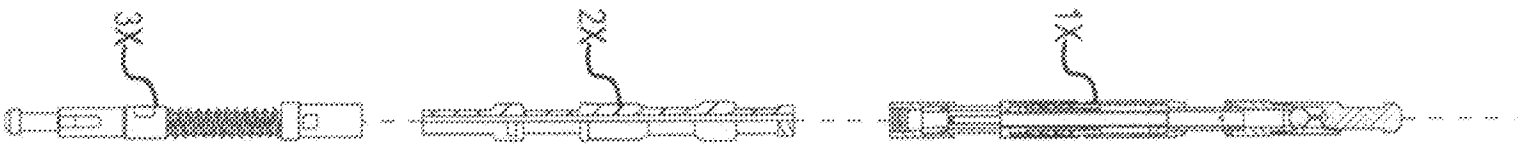
FIG. 3 is a side elevational view of a complete staging tool.

The representation shown in FIG. 3 depicts one preferred embodiment of a complete staging tool. The Staging Tool Seal Assembly 1X is threadedly attached to a locating tool 2X. Such locating tools are commonly available commercially and a tubing stop is depicted. A bumper spring assembly 3X is threadedly attached to the lower end of the locating tool 2X to provide impact absorption from a plunger that would be operating in the next lower chamber.

FIG. 4 depicts a typical well arrangement of production tubing that is commonly set inside a larger diameter pipe or casing that extend to the producing zones of the well (casing not shown for clarity). A production tubing string 40 is shown which typically extends from the surface of the well to the producing zone. At the surface it is terminated at the lubricator 30, and is piped off to a collection means 31. The complete staging tool assembly consisting of the staging tool seal assembly 38, the locating tool 34 and the bumper spring 39 are set in the well at the desired location typically by means of a wireline rig operating from surface, as represented in FIG. 5. This divides the well into separate chambers 32 and 33. The staging tool seal assembly 38 ensures that the flow of gas and liquids in the well that is made vertically upwards through it will not flow back. The lower chamber 33 may be terminated at its lowest extremity by a lower bumper spring 35 or similar stopping device. A plunger 36 operates as a free traveling piston in the lower chamber 33 to assist the vertical upward flow of the gas and liquids. Similarly, a second plunger 37 operates to assist with the upward flow of gas and liquids in the upper chamber 32.

An annular array of magnets 41 is represented in one preferred embodiment in FIG. 1A, so as to align molecules of paraffin and scaling substances in the oil and gas mix, so that they will not adhere to the tubing wall and clog it up.

A bladed turbine 43, with an rf transmitter thereattached, may be arranged at for example, a lower end of the tool assembly 38, as represented in FIG. 4, so as to measure and transmit fluid flow rate data at that juncture in the tubing string 40, or to generate electricity for adjacent sensing systems and communicate with a lower plunger 36, and/or with an upper plunger 37. The dual plungers 36 and 37 in one preferred embodiment, may have contact and parameter sensors 51 as part of an rf transmission systems 45 therein, each with an antenna 46, to transmit data to an antenna 47 on the staging tool 38 for status determination and re-transmission to a surface rf control receiver 49, when these dual plungers 36 and 37 arrive at their respective end points, i.e., the bottom of the well and the upper end of the well 40, or in contact with the staging tool 38, as well as other well operating parameters, as represented in FIG. 4.

The representation shown in FIG. 5 depicts the application of a wireline rig 50 which is typically a truck mounted device operating a cable 51 that is lowered into the well and used to place or extract tools, among other uses. Retrieval would involve opening access to the well through the lubricator 30 and lowering the retrieval tool 52 to the location of the staging tool seal assembly 38, after the upper plunger 37 has been removed. The retrieval tool 52 engages the fishing neck of the staging tool seal assembly and applies an upward force to remove the entire tool from the well.

During such upward (or downward) force, the elastomeric seal assembly 18 is hence protectively covered/uncovered by the articulatable relationship of the seal retractor cup 19 and the retaining sleeve 20 effecting radial displacement, i.e. radial expansion/radial contraction of the seal 18 towards and away from sealing (and wearing) engagement of the walls of the well's tubing. It is to be noted that other embodiments of this concept may include pressurizable/depressurizable annular seals, pivotable swinging of annular seal members or the like.

The operation of the staging tool system relates to the tool run in the well with the sleeve covering the sealing elements protecting them from the tubing wall. When the staging tool is set, the tubing and/or collar stop sets first and then with further jarring down on the staging tool, with the jars on the running tool, it operates to move the sleeve lower exposing the elastomer seals. On retrieval of the staging tool, the pulling tool is set down on top of the fishing neck. Overshot dogs on the pulling tool engage the fishing neck of the staging tool and pulling up the fishing neck of the staging tool exposes an equalizing hole, whereby the pressure above the elastomeric seals is equalized with the pressure below the seals. By further pulling up on the fishing neck of the staging tool after the pressures are equalized, the seal retaining sleeve moves upwardly compressing and enclosing the elastomer seals. Once the retaining sleeve is all the way in its "up" position, then the tubing or collar stop is permitted to release and the entire tool may be lifted out of the well hole.

The invention claimed is:

1. A staging tool arrangement for gas well production assistance, comprising:

an elongated staging tool having an upper portion and a lower portion, the upper portion having a sliding relationship with the lower portion thereof;

a displaceable radially expandable annular seal arranged about the lower portion;

a displaceable enclosure on the lower portion arranged to slidably expose and to slidably enclose the radially expandable annular seal.

2. The staging tool arrangement as recited in claim 1, wherein the annular seal is comprised of at least one tapered ring surrounding a central elongated rod.

3. The staging tool arrangement as recited in claim 2, wherein the at least one annular seal expands into a well-touching and well-sealing orientation when the lower displaceable enclosure is slid from a position radially adjacent the annular seal.

4. The staging tool arrangement as recited in claim 2, wherein the at least one tapered ring is in a longitudinally abutting thick radius of a first ring against a thin radius of a second adjacent tapered ring.

5. The staging tool arrangement as recited in claim 2, wherein the at least one annular seal is radially adjacent a tapered portion of a longitudinally movable control rod, which facilitates radial movement of the at least one annular seal.

6. The staging tool arrangement as recited in claim 2, wherein the elongated staging tool is arranged in rf communication in the gas well, with an upper plunger and a lower plunger, to facilitate control and communication therebetween.

7. The staging tool arrangement as recited in claim 2, wherein the elongated staging tool has a bladed turbine attached therewith, to monitor fluid flow adjacent the elongated staging tool.

8. The staging tool arrangement as recited in claim 7, wherein the bladed turbine is an electric generator.

9. A method of protecting wearable annular seal elements of a gas well staging tool member in a gas well system, comprising:

mating an elongated upper portion of the gas well staging tool with an elongated lower portion of the staging tool;

arranging at least one radially displaceable annular seal element between the upper portion of the gas well staging tool and the lower portion of the gas well staging tool;

moving the upper portion of the gas well staging tool relative to the lower portion of the gas well staging tool;

displacing the at least one annular seal element of the gas well staging tool radially, upon displacement of the lower portion of the staging tool.

10. The method as recited in claim 9, wherein the lower portion of the gas well staging tool comprises a longitudinally slotted seal enclosure.

11. The method as recited in claim 9, wherein the gas well staging tool is arranged within a gas well at an intermediate location between an upper plunger in the gas well and a lower plunger in the gas well.

12. A method for operating a staging tool assembly in a gas well to protect a tool seal arrangement operating within the gas well, comprising:

covering annular seal elements of the staging tool with a sleeve covering portion, which covering portion protects the seal elements from the tubing wall;

setting the staging tool within the well;

jarring down on the staging tool within the gas well, so as to move the sleeve covering portion of the staging tool lower; and exposing and permitting the radial expansion of the annular seal elements by the jarring action.

13. The method as recited in claim 12, including:

retrieving the staging tool, wherein a pulling tool is set down on top of the fishing neck, and a set of overshot dogs on the pulling tool engage the fishing neck of the staging tool;

pulling up on the fishing neck of the staging tool so as to exposes an equalizing hole, whereby the pressure above the annular seals is equalized with the pressure below the seals.

14. The method as recited in claim 12, including:

pulling up on the fishing neck of the staging tool after the pressures are equalized;

moving the seal retaining sleeve upwardly thus compressing and enclosing the annular seals to permit the entire tool assembly to be lifted out of the well hole.

* * * * *